US009424825B2

(12) United States Patent
Osuga et al.

(10) Patent No.: US 9,424,825 B2
(45) Date of Patent: Aug. 23, 2016

(54) KEYBOARD APPARATUS FOR AN ELECTRONIC MUSICAL INSTRUMENT

(71) Applicant: YAMAHA CORPORATION, Hamamatsu-shi, Shizuoka-ken (JP)

(72) Inventors: Ichiro Osuga, Hamamatsu (JP); Hiroshi Harimoto, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/499,547

(22) Filed: Sep. 29, 2014

(65) Prior Publication Data

US 2015/0090104 A1 Apr. 2, 2015

(30) Foreign Application Priority Data

Sep. 27, 2013 (JP) ..... 2013-202401

(51) Int. Cl.
*G10H 1/32* (2006.01)
*G10H 1/34* (2006.01)

(52) U.S. Cl.
CPC ..... *G10H 1/34* (2013.01); *G10H 1/32* (2013.01); *G10H 1/346* (2013.01)

(58) Field of Classification Search
CPC ..... G10H 1/32; G10H 1/34
USPC ..... 84/644, 670
See application file for complete search history.

(56) References Cited

U.S. PATENT DOCUMENTS 6,051,767 A * 4/2000 Masubuchi ..... G10H 1/346 84/423 R
6,075,213 A * 6/2000 Ichiro ..... G10H 1/346 200/1 B
6,133,517 A * 10/2000 Masubuchi ..... G10H 1/344 84/423 R
2005/0160903 A1* 7/2005 Nagaoka ..... G10H 1/344 84/745
2007/0017342 A1* 1/2007 Nishida ..... G10C 3/12 84/423 R
2007/0295192 A1* 12/2007 Watanabe ..... G10H 1/344 84/423 R
2013/0074684 A1* 3/2013 Iwase ..... G10H 1/346 84/745
2015/0090103 A1* 4/2015 Osuga ..... G10H 1/346 84/744
2015/0090104 A1* 4/2015 Osuga ..... G10H 1/346 84/744
2015/0220105 A1* 8/2015 Harimoto ..... G05G 5/03 200/239

FOREIGN PATENT DOCUMENTS

JP 11175067 A 7/1999

* cited by examiner

*Primary Examiner* — David Warren
(74) *Attorney, Agent, or Firm* — Rossi, Kimms & McDowell LLP

(57) ABSTRACT

A keyboard apparatus has a plurality of white keys and black keys each of which pivot. The keyboard apparatus also has a plurality of reaction force generation members 21*w* and 21*b* provided for the white keys and the black keys, respectively. The reaction force generation members 21*w* and 21*b* have dome portions 21*w*1 and 21*b*1, respectively, which are thin and shaped like a dome so as to be elastically deformed by depression, and base portions 21*w*3 and 21*b*3, respectively, which are thick and are formed integrally with the dome portions 21*w*1 and 21*b*1 to support the dome portions 21*w*1 and 21*b*1, the base portions 21*w*3 and 21*b*3 jutting outward from respective lower end surfaces of the dome portions 21*w*1 and 21*b*1. The vertical position of the lower end of the dome portion 21*w*1 is displaced from the vertical position of the lower end of the dome portion 21*b*1.

9 Claims, 8 Drawing Sheets

KEYBOARD APPARATUS FOR AN ELECTRONIC MUSICAL INSTRUMENT

BACKGROUND OF THE INVENTION

1. Field of the Invention

The present invention relates to a keyboard apparatus for an electronic musical instrument, the keyboard apparatus having reaction force generation members for generating a reaction force by elastically deforming in response to a player's operation.

2. Description of the Related Art

Conventionally, there are keyboard musical instruments such as electronic organs and electronic pianos having rubber-dome reaction force generation members for exerting reaction force against the depression of keys. For example, Japanese Unexamined Patent Publication No. 11-175067 discloses a keyboard apparatus having reaction force generation members (key switches) each having a rubber dome on a circuit board fastened to a frame which supports keys located above the frame so that the keys can pivot. The reaction force generation members of white keys and black keys are configured the same. The reaction force generation members for black keys are located behind the reaction force generation members for white keys. Furthermore, the reaction force generation members are elastically deformed by being depressed by the keys depressed by a player, so that the player can perceive the same key touch on both the white keys and the black keys.

SUMMARY OF THE INVENTION

However, the above-described conventional keyboard apparatus is configured such that the height of the reaction force generation members of the white keys is the same as the height of the reaction force generation members of the black keys, while the amount of stroke is different between the white keys and the black keys. Therefore, it is difficult for the conventional keyboard apparatus to provide the same key touch both on the white keys and the black keys. Furthermore, not only in the case of the above-described conventional apparatus but also in many cases, conventional apparatuses generally have a keyboard in which the structure is different between white keys and black keys, and more specifically, the length of each key, the amount of keystroke, the position of an axis of the key and the like are different between the white keys and the black keys. In order to solve these problems, reaction force generation members whose size, shape, function and the like are different between white keys and black keys have to be employed. In a case where the dome-shaped reaction force generation members such as the above-described conventional art are employed, however, reaction force generation members whose size, shape, function and the like are almost the same both on white keys and black keys are required in order to provide a player with the same key touch both on the white keys and the black keys.

The present invention was accomplished to solve the above-described problems and to satisfy the request, and an object thereof is to provide a keyboard apparatus for an electronic musical instrument, the keyboard apparatus providing a player with almost the same key touch both on white keys and black keys. As for descriptions about respective constituent features of the present invention, furthermore, reference letters of corresponding components of embodiments described later are provided in parentheses to facilitate the understanding of the present invention. However, it should not be understood that the constituent features of the present invention are limited to the corresponding components indicated by the reference letters of the embodiments.

In order to achieve the above-described object, the present invention provides a keyboard apparatus for an electronic musical instrument, the keyboard apparatus including a plurality of keys composed of white keys (11*w*) and black keys (11*b*), each key pivoting about a corresponding pivot axis (Cw, Cb) so that a front end of the key can move up and down, and a plurality of reaction force generation members (21*w*, 21*b*) which are provided for the plurality of keys, respectively, and are made of an elastic body, and each of which is depressed by a depression of a corresponding key to generate a reaction force against the depression of the corresponding key, wherein each of the reaction force generation members has a dome portion (21*w*1, 21*b*1) which is thin and shaped like a dome so as to be elastically deformed by depression, and a base portion which is thick and is formed integrally with the dome portion to support the dome portion, the base portion extending downward seamlessly from all circumferences of a lower end of the dome portion to jut outward from a lower end surface of the dome portion; and a position of a point (Pw, Pw') of intersection between the lower end surface of the dome portion of the white key and an axis line (Yw, Yb) of the dome portion of either the white key or the black key is displaced from a position of a point (Pb, Pb') of intersection between the lower end surface of the dome portion of the black key and the axis line of the dome portion of the either key.

In this case, for example, a position of a point (Pw) of intersection between the lower end surface of the dome portion of the white key and the axis line of the dome portion of the white key may be displaced in a vertical direction of the keys from a position of a point (Pb) of intersection between the lower end surface of the dome portion of the black key and the axis line of the dome portion of the black key. Furthermore, the dome portion of the white key may have the same shape and size as the dome portion of the black key.

According to the present invention configured as above, by displacing the position of the point of intersection between the lower end surface of the dome portion of the white key and the axis line of the dome portion of either the white key or the black key from the position of the point of intersection between the lower end surface of the dome portion of the black key and the axis line of the dome portion of the either key, the lower end surface of the dome portion of the white key is substantially displaced from the lower end surface of the dome portion of the black key. As a result, the keyboard apparatus whose reaction force generation members for the white keys have a height different from the height of the reaction force generation members for the black keys can have the dome portions configured the same or roughly the same for both the white keys and the black keys to provide a player with roughly the same key touch on the white keys and the black keys.

It is another feature of the present invention that the position of the point of intersection between the lower end surface of the dome portion of the white key and the axis line of the dome portion of the white key is displaced in a direction in which the white key and the black key extend from the position of the point of intersection between the lower end surface of the dome portion of the black key and the axis line of the dome portion of the black key. As a result, the keyboard apparatus in which the reaction force generation members for the white keys are located in a position different in the direction in which the white keys and the black keys extend from the reaction force generation members for the black keys can provide a player with roughly the same key touch on the white keys and the black keys.

It is a further feature of the present invention that the reaction force generation members of the white keys are formed integrally with the reaction force generation members of the black keys; and the base portion of the white key is shaped differently from the base portion of the black key. In this case, for example, a step (21*p*, 21*q*) or slope (21*r*) may be provided between an upper surface of the base portion of the white key and an upper surface of the base portion of the black key. Only by providing the integrally formed reaction force generation members for the white keys and the black keys at a position with varying heights, as a result, the base portions of the white keys and the black keys can absorb the difference in height between the white keys and the black keys. Therefore, the keyboard apparatus not only provides a player with roughly the same key touch both on the white keys and the black keys, but also facilitates the assembly of the reaction force generation members.

It is a still further feature of the present invention that the reaction force generation members of the white keys are formed integrally with the reaction force generation members of the black keys; and an undersurface of the base portion of the white key and an undersurface of the base portion of the black key are seamlessly inclined in the direction in which the white key and the black key extend. Only by providing the integrally formed reaction force generation members for the white keys and the black keys at a position with required varying heights, as a result, the inclination of the undersurface of the base portions of the white keys and the black keys can absorb the difference in height between the white keys and the black keys. Therefore, the keyboard apparatus not only provides a player with roughly the same key touch both on the white keys and the black keys, but also facilitates the assembly of the reaction force generation members.

Furthermore, a feature of the present invention can be also understood as providing a keyboard apparatus for an electronic musical instrument, the keyboard apparatus including a plurality of keys composed of white keys (11*w*) and black keys (11*b*), each key pivoting about a corresponding pivot axis (Cw, Cb) so that a front end of the key can move up and down, and a plurality of reaction force generation members (21*w*, 21*b*) which are provided for the plurality of keys, respectively, and are made of an elastic body, and each of which is depressed by a depression of a corresponding key to generate a reaction force against the depression of the corresponding key, wherein each of the reaction force generation members has a body portion (21*w*1, 21*b*1) which is thin so as to be elastically deformed by depression, and a base portion (21*w*3, 21*b*3) which is thick and is formed integrally with the body portion to support the body portion, the base portion extending downward seamlessly from all circumferences of a lower end of the body portion to jut outward from the lower end of the body portion; and the lower end of the body portion of the white key is displaced in a vertical direction from the lower end of the body portion of the black key.

According to the feature of the invention, the keyboard apparatus in which the reaction force generation members for the white keys have a height different from the height of the reaction force generation members for the black keys can be configured such that the body portions for the white keys have the same or roughly the same configuration as the body portions for the black keys. As a result, the keyboard apparatus can provide a player with roughly the same key touch both on the white keys and the black keys.

DESCRIPTION OF THE PREFERRED EMBODIMENT

In the following, the invention will be further explained with the description of several embodiments of the invention. It is noted that although the embodiments do show the reaction force generation members as being embodied by an elastic dome construction, the invention is not limited to this implementation. The invention can be implemented using any suitable reaction force generation element. For example the reaction force generation element can include a spring member or an elastic element that generates a resisting force when actuated; for example a metal and/or plastic spring, a rubber and/or foam element, or an elastic rubber dome, or any other suitable material and/or construction, or combinations thereof. As in several embodiments, the reaction force generation elements can be the same for each key in the keyboard, but the invention is not limited to this implementation. Different reaction force generation elements can be used for any key, for example different ones for white and black keys, or for example different ones for the left and right side of the keyboard.

Further, the definition of the positions of the points (Pw, Pw', Pb, Pb') of intersection, which is described in the summary of the invention, will be explained as follows. The definition of the positions of the points of intersection were provided in order to define a difference in the direction of axis line between the lower end surface of the dome portion of the white key and the lower end surface of the dome portion of the black key. This will be explained with reference to FIG. 16. As indicated FIG. 16(A), a case where the axis line Yw of the dome portion 21*w*1 of the reaction force generation member 21*w* of the white key 11*w* is parallel with the axis line Yb of the dome portion 21*b*1 of the reaction force generation member 21*b* of the black key 11*b* will be explained. In this case, a difference ΔL in distance in the direction of the axis lines Yw and Yb between the respective lower end surfaces of the dome portions 21*w*1 and 21*b*1 can be defined as a distance in the direction of the axis lines Yw and Yb between the intersection point Pw between the lower end surface of the dome portion 21*w*1 and the axis line Yw, and the intersection point Pb between the lower end surface of the dome portion 21*b*1 and the axis line Yb. The difference ΔL in distance can be also defined as a difference in distance between the intersection point Pw between the lower end surface of the dome portion 21*w*1 and the axis line Yw, and an intersection point Pb' between the lower end surface of the dome portion 21*b*1 and the axis line Yw, and can be also defined as a difference in distance between an intersection point Pw' between the lower end surface of the dome portion 21*w*1 and the axis line Yb, and the intersection point Pb between the lower end surface of the dome portion 21*b*1 and the axis line Yb.

Figure 16A:
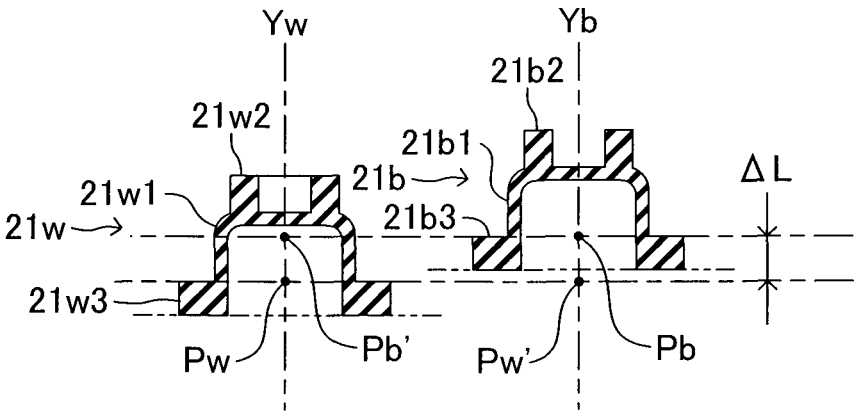
FIGS. 16(A) and (B) are illustrations for explaining respective positions of lower end surfaces of dome portions of the reaction force generation members of a white key and a black key.
Figure 16B:
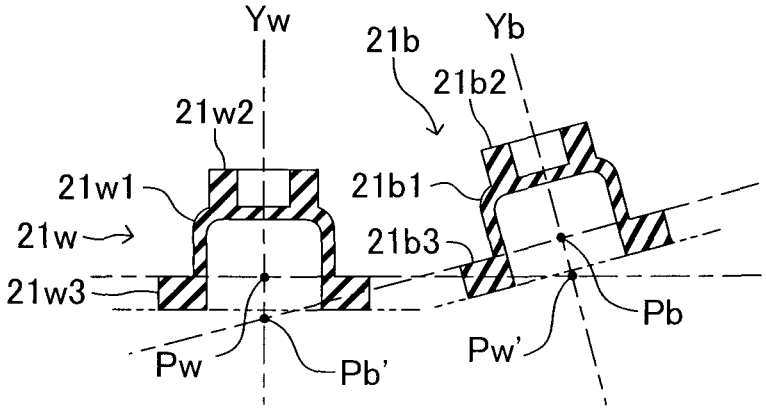

As indicated in FIG. 16(B), however, there are cases where the reaction force generation member 21*b* for the black key is assembled such that the reaction force generation member 21*b* for the black key is inclined against the reaction force generation member 21*w* for the white key. In such cases, the axis lines Yw and Yb are not parallel with each other. In such cases, therefore, the difference between the position of the lower end surface of the dome portion 21*w*1 in the direction of the axis line Yw and the position of the lower end surface of the dome portion 21*b*1 in the direction of the axis line Yb cannot be defined by use of the axis lines Yw and Yb. Therefore, the difference in position of the respective lower end surfaces of the dome portions 21*w*1 and 21*b*1 will be defined by use of either of the axis line Yw of the dome portion 21*w*1 or the axis line Yb of the dome portion 21*b*1, including the case where the axis lines Yw and Yb are parallel with each other. More specifically, a distance in the direction of the axis line Yw between the intersection point Pw between the lower end surface of the dome portion 21*w*1 and the axis line Yw, and the intersection point Pb' between the lower end surface of the dome portion 21*b*1 and the axis line Yw will be defined. Alternatively, a distance in the direction of the axis line Yb between the intersection point Pb between the lower end surface of the dome portion 21*b*1 and the axis line Yb, and the intersection point Pw' between the lower end surface of the dome portion 21*w*1 and the axis line Yb will be defined. In this case as well, furthermore, since the inclination of the axis line Yb against the axis line Yw is exaggerated in FIG. 16(B), there substantially exists a distance in the direction of the axis line Yw (or the axis line Yb) between the lower end surface of the dome portion 21*w*1 and the lower end surface of the dome portion 21*b*1 as in the case of FIG. 16(A).

a. First Embodiment

Figure 1:
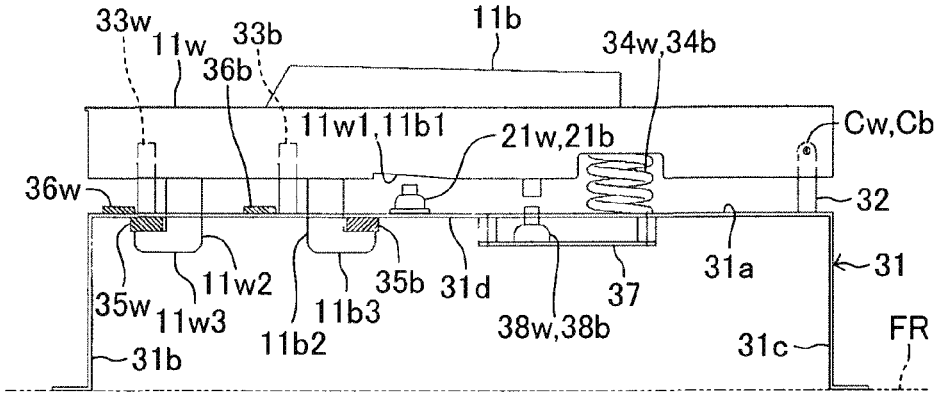
FIG. 1 is a schematic side view of a keyboard apparatus according to the first embodiment of the present invention.
Figure 2:
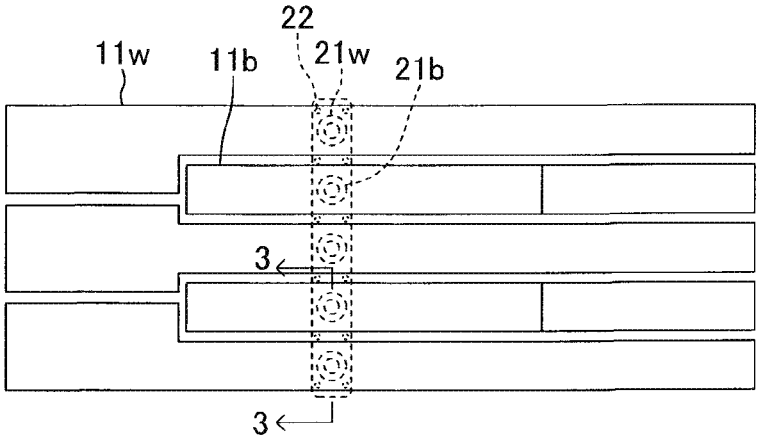
FIG. 2 is a schematic top view of the keyboard apparatus of FIG. 1.

The first embodiment of the present invention will now be described with reference to the drawings. FIG. 1 is a schematic side view indicative of a keyboard apparatus according to the first embodiment seen from the right. FIG. 2 is a schematic top view of the keyboard apparatus. In schematic side views of the keyboard apparatus shown in FIG. 1 and FIGS. 4, 7, 11 and 15 which will be described later, the front-rear direction of the keyboard apparatus is defined as the lateral direction, and the vertical direction of the keyboard apparatus is defined as the vertical direction.

The keyboard apparatus has a plurality of white keys 11*w* and a plurality of black keys 11*b* which are to be depressed and released by a player. The keyboard apparatus also has a plurality of reaction force generation members 21*w*, 21*b* each exerting a reaction force against a player's depression of its corresponding key. The white key 11*w* is long in the front-rear direction, has a U-shaped cross-section which is open downward, and is located on a flat upper plate portion 31*a* of a key frame 31. The key frame 31 has flat leg portions 31*b* and 31*c* extending downward at the front end and the rear end of the upper plate portion 31*a*, with respective lower end portions of the leg portions 31*b* and 31*c* being fastened to a frame FR provided within a musical instrument. To the upper surface of the rear end portion of the upper plate portion 31*a* of the key frame 31, a pair of plate-like key supporting portions 32 erected to be opposed with each other inside the white key 11*w* is fastened. On the upper portion of each key supporting portion 32, a projecting portion jutting outward is provided to face each other. The projecting portion of each key supporting portion 32 is inserted into a through-hole provided on the both sides of the rear end portion of the white key 11*w* from inside the white key 11*w* so that the key can rotate. By such a configuration, the white key 11*w* is supported by the pair of key supporting portions 32 so that the white key 11*w* can pivot to allow the front end of the white key 11*w* to move in the vertical direction. Hereafter, the center of the pivoting of the white key 11*w* will be referred to as a pivot axis Cw. The black keys 11*b* are configured similarly to the white keys 11*w*, except that the black keys 11*b* are configured to have a raised upper face of the front portion. Each of the black keys 11*b* is also supported by the key supporting portions 32 so that the black key 11*b* can pivot about a pivot axis Cb to allow the front end of the black key 11*b* to move in the vertical direction. In this embodiment, the pivot axis Cb of the black key 11*b* is situated at the same position in the front-rear direction and in the vertical direction as the pivot axis Cw of the white key 11*w*.

On the upper surface of the upper plate portion 31*a* of the key frame 31, a key guide 33*w* is erected to be situated under the front end portion of the white key 11*w*, while a key guide 33*b* is erected to be situated under the front end portion of the black key 11*b*. The key guides 33*w* and 33*b* are inserted into the white key 11*w* and the black key 11*b*, respectively, so that the key guides 33*w* and 33*b* can slide in order to prevent the white key 11*w* and the black key 11*b* from moving in the lateral direction when the keys 11*w* and 11*b* pivot in the vertical direction.

A reaction force generation member 21*w* is provided for each of the white keys 11*w*, while a reaction force generation member 21*b* is provided for each of the black keys 11*b*. The reaction force generation members 21*w* and 21*b* are fastened to the upper surface of the upper plate portion 31*a* of the key frame 31 such that the reaction force generation member 21*w* and 21*b* are situated below a central portion of the white key 11*w* and the black key 11*b*, respectively, in the front-rear direction. In this case, the reaction force generation member 21*w* of the white key 11*w* is located on the same position in the front-rear direction as the reaction force generation member 21*b* of the black key 11*b*, so that the reaction force generation members 21*w* and 21*b* are arranged in a row in the lateral direction of the keyboard. Furthermore, the reaction force generation members 21*w* and 21*b* are integrally formed in one piece.

Figure 3:
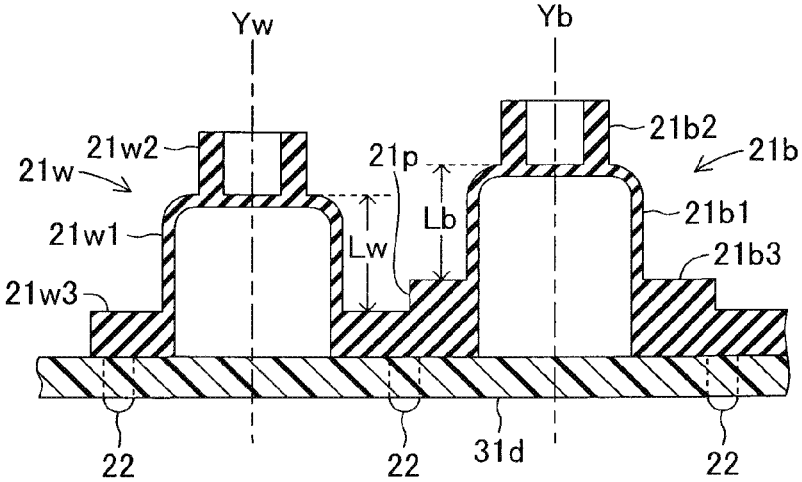
FIG. 3 is an enlarged cross sectional view of reaction force generation members seen along a line 3-3 of FIG. 2.

Hereafter, the reaction force generation members 21*w* and 21*b* will be explained. FIG. 3 is an enlarged cross-sectional view of the reaction force generation members seen along a line 3-3 of FIG. 2. The plurality of reaction force generation members 21*w* and 21*b* are integrally formed of elastic rubber. The reaction force generation members 21*w* and 21*b* have dome portions 21*w*1 and 21*b*1, top portions 21*w*2 and 21*b*2, and base portions 21*w*3 and 21*b*3, respectively. The dome portions 21*w*1 and 21*b*1 are point-symmetric about axis lines Yw and Yb, respectively, to be shaped like a dome (a bowl) which is thin and deformable by depression from above. Conversely, the axis lines Yw and Yb are central axes of the dome portions 21*w*1 and 21*b*1, and the top portions 21*w*2 and 21*b*2, respectively. Furthermore, the axis lines Yw and Yb are lines of action of force, the lines each passing through the starting point of the reaction force vector to extend in a vector direction. More specifically, the dome portions 21*w*1 and 21*b*1 are elastically deformed by an increasing depression from above to gradually increase a reaction force. After the reaction force has reached its peak, however, the dome portions 21*w*1 and 21*b*1 buckle to sharply decrease the reaction force to gradually increase the reaction force. The dome portion 21*w*1 and the dome portion 21*b*1 have the same shape. Particularly, a distance Lw ranging from the lower end surface to the upper end surface of the dome portion 21*w*1 is equal to a distance Lb ranging from the lower end surface to the upper end surface of the dome portion 21*b*1. The dome portions 21*w*1 and 21*b*1 are equivalent to body portions of the present invention, seen from a different viewpoint.

The top portions 21*w*2 and 21*b*2 are point-symmetric about the axis lines Yw and Yb, respectively, to be shaped like a cylinder. Furthermore, the top portions 21*w*2 and 21*b*2 are thick so that the top portions 21*w*2 and 21*b*2 are hardly deformed by depression from above. The top portions 21*w*2 and 21*b*2 are designed such that the undersurfaces of the top portions 21*w*2 and 21*b*2 are connected with the upper surfaces of the dome portions 21*w*1 and 21*b*1, respectively, while the top portions 21*w*2 and 21*b*2 have a uniform height at all circumferences to have a flat upper surface. At a circumferential part of the upper portion of the top portions 21*w*2 and 21*b*2, a notch (not shown) is provided so that air can escape between the inside and the outside of the top portions 21*w*2 and 21*b*2. The top portions 21*w*2 and 21*b*2 have the same shape.

The base portions 21*w*3 and 21*b*3 extend downward seamlessly from all circumferences of the lower end of the dome portions 21*w*1 and 21*b*1, respectively, to jut outward from the lower end surface of the dome portions 21*w*1 and 21*b*1, respectively. The base portions 21*w*3 and 21*b*3 are also thick so that the base portions 21*w*3 and 21*b*3 are hardly deformed by depression from above. The plurality of base portions 21*w*3 and 21*b*3 are seamlessly formed integrally with the neighboring base portions 21*b*3 and 21*w*3 such that the bottom surfaces of the base portions 21*w*3 and 21*b*3 form a flat surface. Although the upper surface of each of the base portions 21*w*3 and 21*b*3 is flat, a step 21*p* is provided between the upper surfaces of the base portions 21*w*3 and 21*b*3. Because of this step, the base portion 21*w*3 for the white key 11*w* is lower than the base portion 21*b*3 of the black key 11*b*.

On the undersurface of the base portions 21*w*3 and 21*b*3, a plurality of leg portions 22 jutting perpendicularly downward from the undersurface of the base portions 21*w*3 and 21*b*3 to be shaped like a cylinder are provided at proper positions. The plurality of leg portions 22 are also formed integrally with the dome portions 21*w*1 and 21*b*1, the top portions 21*w*2 and 21*b*2, and the base portions 21*w*3 and 21*b*3 by elastic body. The leg portions 22, which are provided in order to fasten the reaction force generation members 21*w* and 21*b* to a supporting portion 31*d* provided on the upper plate portion 31*a* of the key frame 31, are pressed into penetrating holes provided on the supporting portion 31*d*. Without using the leg portions 22, furthermore, the undersurface of the base portions 21*w*3 and 21*b*3 may be fastened to the upper plate portion 31*a* (the supporting portion 31*d*) of the key frame 31 with an adhesive or the like.

Furthermore, since the upper surface of the supporting portion 31*d* is a horizontal plane, the reaction force generation members 21*w* and 21*b* are fastened to the upper surface of the supporting portion 31*d*, with the axis lines Yw and Yb being kept parallel with each other and vertical with respect to the supporting portion 31*d*. As a result, by the difference in the height between the base portions 21*w*3 and 21*b*3 brought about by the step 21*p*, the upper surface of the top portion 21*w*2 of the reaction force generation member 21*w* is lower than the upper surface of the top portion 21*b*2 of the reaction force generation member 21*b* in the state where the reaction force generation members 21*w* and 21*b* are fastened to the upper surface of the supporting portion 31*d*. The difference in height is adjusted such that the amount of downward travel of the upper surface of the front end of the white key 11*w* by the depression of the white key 11*w* is roughly the same as the amount of downward travel of the upper surface of the front end of the black key 11*b* by the depression of the black key 11*b* at the start of deformation of the reaction force generation member 21*w* (the dome portion 21*w*1) and the reaction force generation member 21*b* (the dome portion 21*b*1), at respective peaks of the reaction forces of the reaction force generation members 21*w* and 21*b*, and at the end of the deformation of the reaction force generation members 21*w* and 21*b*.

On the undersurfaces of the white key 11*w* and the black key 11*b*, depression portions 11*w*1 and 11*b*1 for depressing the reaction force generation members 21*w* and 21*b* from above are provided, respectively, such that the depression portions 11*w*1 and 11*b*1 face the upper surfaces of the top portions 21*w*2 and 21*b*2 of the reaction force generation members 21*w* and 21*b*, respectively. Each of the depression portions 11*w*1 and 11*b*1 is shaped like a flat plate, and has an undersurface which is flat and is tilted such that the front side is high, and the rear side is low with respect to the undersurface of the white key 11*w* and the black key 11*b*. The tilting angle of the depression portions 11*w*1 and 11*b*1 is designed such that the normal lines of the undersurfaces of the depression portions 11*w*1 and 11*b*1 (straight lines perpendicular to the undersurfaces) become parallel to the axis lines Yw and Yb of the reaction force generation members 21*w* and 21*b* when the reaction forces of the reaction force generation members 21*w* and 21*b* reach their peaks, respectively. At the points in time when the reaction forces of the reaction force generation members 21*w* are 21*b* reach their peaks, respectively, furthermore, the directions in which the reaction forces act coincide with the directions of the axis lines Yw and Yb of the reaction force generation members 21*w* and 21*b*, respectively. Therefore, it can be understood that at the points in time when the reaction forces of the reaction force generation members 21*w* and 21*b* reach their peaks, respectively, the direction in which the reaction force acts is different between the white key 11*w* and the black key 11*b*, while the directions in which the reaction force generation members 21*w* and 21*b* are depressed at the points in time when the reaction forces of the reaction force generation members 21*w* and 21*b* reach their peaks coincide with the directions in which the reaction force generation members 21*w* and 21*b* exert a reaction force, respectively. In this case, the inclination of the undersurface of the depression portion 11*b*1 of the black key 11*b* against the horizontal surface (the undersurface of the black key 11*b*) is slightly greater than the inclination of the undersurface of the depression portion 11*w*1 of the white key 11*w* against the horizontal surface (the undersurface of the white key 11*w*). The respective undersurfaces of the depression portions 11*w*1 and 11*b*1 may not be flat but may be spherical as long as the normal lines of the undersurfaces including respective depression points of the depression portions 11*w*1 and 11*b*1 become parallel to the axis lines Yw and Yb, respectively, at the points in time when the reaction forces reach their peaks, respectively. Furthermore, the depression portions 11*w*1 and 11*b*1 may be a rib shaped like a cross, a letter H or the like protruding downward from the inner upper surface of the white key 11*w* and the black key 11*b*, respectively.

Furthermore, the keyboard apparatus has a spring 34*w* for the white key 11*w* and a spring 34*b* for the black key 11*b*. The springs 34*w* and 34*b* are provided between the white key 11*w* and the black key 11*b*, and the upper plate portion 31*a* of the key frame 31, respectively, such that the springs 34*w* and 34*b* are situated at the midpoint between the depression portions 11*w*1 and 11*wb*, and the key supporting portions 32, respectively. The springs 34*w* and 34*b* urge the white key 11*w* and the black key 11*b* upward, respectively, with respect to the upper plate portion 31*a*. The springs 34*w* and 34*b* may not be a coil, but may be a plate spring as long as the springs can urge the white key 11*w* and the black key 11*b* upward.

The white key 11*w* has an extending portion 11*w*2 which extends downward from the front end of the white key 11*w*. At the lower end of the extending portion 11*w*2, an engagement portion 11*w*3 jutting frontward is provided such that the engagement portion 11*w*3 is inserted below the upper plate portion 31*a* from above through a through-hole provided on the upper plate portion 31*a* of the key frame 31. On the undersurface of a front end portion of the upper plate portion 31*a* of the key frame 31, an upper limit stopper member 35*w* is provided. The upper limit stopper member 35*w* is a cushioning material such as felt. By coming into contact with the engagement portion 11*w*3 of the white key 11*w*, the upper limit stopper member 35*w* restricts upward displacement of the front end portion of the white key 11*w*. On the upper surface of the front end portion of the upper plate portion 31*a* of the key frame 31, a lower limit stopper member 36*w* is provided. The lower limit stopper member 36*w* is also a cushioning material such as felt. By coming into contact with the undersurface of the front end portion of the white key 11*w*, the lower limit stopper member 36*w* restricts downward displacement of the front end portion of the white key 11*w*.

The black key 11*b* has an extending portion 11*b*2 which extends downward from the front end of the black key 11*b*. At the lower end of the extending portion 11*b*2, an engagement portion 11*b*3 jutting rearward is provided such that the engagement portion 11*b*3 is inserted below the upper plate portion 31*a* from above through a through-hole provided on the upper plate portion 31*a* of the key frame 31. On the undersurface of a middle portion of the upper plate portion 31*a* of the key frame 31, an upper limit stopper member 35*b* is provided. The upper limit stopper member 35*b* is also a cushioning material such as felt. By coming into contact with the engagement portion 11*b*3 of the black key 11*b*, the upper limit stopper member 35*b* restricts upward displacement of the front end portion of the black key 11*b*. On the upper surface of the middle portion of the upper plate portion 31*a* of the key frame 31, a lower limit stopper member 36*b* is provided. The lower limit stopper member 36*b* is also a cushioning material such as felt. By coming into contact with the undersurface of the front end portion of the black key 11*b*, the lower limit stopper member 36*b* restricts downward displacement of the front end portion of the black key 11*b*.

To the undersurface of the upper plate portion 31*a* of the key frame 31, electric circuit boards 37 are fastened such that the electric circuit boards 37 are situated slightly behind the reaction force generation members 21*w* and 21*b*, respectively, to be parallel to the upper plate portion 31*a*. To the upper surface of the electric circuit boards 37, dome-shaped key switches 38*w* and 38*b* for the white key 11*w* and the black key 11*b* are fastened, respectively. The key switches 38*w* and 38*b* are changed from an off-state to an on-state by a depression of a jutting portion jutting from the undersurface of the white key 11*w* and the black key 11*b* at the time of a depression of a key to detect a user's depression/release of the white key 11*w* and the black key 11*b*. The detection of the depression/release of a key by the key switch 38*w* and 38*b* is used for control of generation of a musical tone signal.

Next, the operation of the keyboard apparatus according to the first embodiment configured as above will be explained. When a player starts depressing the white key 11*w* or the black key 11*b*, the depressed white key 11*w* or black key 11*b* starts pivoting about the pivot axis Cw or Cb, resisting a reaction force exerted by the spring 34*w* or 34*b*, so that the front end portion of the white key 11*w* or the black key 11*b* moves downward to allow the engagement portion 11*w*3 or 11*b*3 to be released from the upper limit stopper member 35*w* or 35*b* to allow the depression portion 11*w*1 or 11*b*1 to come into contact with the rear end of the upper surface of the top portion 21*w*2 or 21*b*2 of the reaction force generation member 21*w* or 21*b*. If the depressed white key 11*w* or black key 11*b* is depressed further, the front end portion of the white key 11*w* or the black key 11*b* moves downward, so that the dome portion 21*w*1 or 21*b*1 of the reaction force generation member 21*w* or 21*b* starts being deformed by the depression by the depression portion 11*w*1 or 11*b*1. As a result, the player starts recognizing not only the reaction force exerted by the spring 34*w* or 34*b* but also the gradually increasing reaction force exerted by the reaction force generation member 21*w* or 21*b*.

If the depressed white key 11*w* or black key 11*b* is depressed further, the reaction force of the reaction force generation member 21*w* or 21*b* reaches its peak, so that the dome portion 21*w*1 or 21*b*1 starts buckling and deforming. As a result, the player can recognize a clear feeling of click. Slightly later than the buckling, furthermore, the key switch 38*w* or 38*b* turns from the off-state to the on-state by a depression of the jutting portion jutting from the undersurface of the white key 11*w* or the black key 11*b*. In response to the change to the on-state of the key switch 38*w* or 38*b*, a musical tone signal generation circuit which is not shown starts generating a musical tone signal.

If the depressed white key 11*w* or black key 11*b* is depressed further, the undersurface of the front end portion of the white key 11*w* or the black key 11*b* comes into contact with the lower limit stopper member 36*w* or 36*b* to stop the pivoting of the white key 11*w* or the black key 11*b*. In this state, the elastic deformation of the reaction force generation member 21*w* or 21*b* also stops. If the white key 11*w* or the black key 11*b* is released, the front end portion of the white key 11*w* or the black key 11*b* moves upward because of the reaction forces of the reaction force generation member 21*w* or 21*b* and the spring 34*w* or 34*b*. In the course during which the front end portion of the white key 11*w* or the black key 11*b* moves to return upward, the key switch 38*w* or 38*b* changes from the on-state to the off-state, so that the musical tone signal generation circuit which is not shown controls the termination of the generation of the musical tone signal. If the front end portion of the white key 11*w* or the black key 11*b* moves upward, furthermore, the engagement portion 11*w*3 or 11*b*3 comes into contact with the upper limit stopper member 35*w* or 35*b* to allow the white key 11*w* or the black key 11*b* to return to the key-release state.

The keyboard apparatus configured to operate as above is designed such that because of the difference in thickness between the base portion 21*w*3 (the length in the direction of the axis line Yw) and the base portion 21*b*3 (the length in the direction of the axis line Yb), the amount of downward travel of the upper surface of the front end of the white key 11*w* by the depression of the white key 11*w* is roughly the same as the amount of downward travel of the upper surface of the front end of the black key 11*b* by the depression of the black key 11*b* at the start of deformation of the reaction force generation member 21*w* (the dome portion 21*w*1) and the reaction force generation member 21*b* (the dome portion 21*b*1), at respective peaks of the reaction forces of the reaction force generation members 21*w* and 21*b*, and at the end of the deformation of the reaction force generation members 21*w* and 21*b*. In spite of the difference in structure between the white key 11*w* and the black key 11*b*, as a result, a player of the keyboard apparatus can operate both the white key 11*w* and the black key 11*b* without any feeling of strangeness.

The keyboard apparatus is also designed such that the dome portion 21*w*1 and the top portion 21*w*2 have the same shape and size as the dome portion 21*b*1 and the top portion 21*b*2, respectively, although the height of the lower end surface of the dome portion is different between the dome portion 21*w*1 and the dome portion 21*b*1 because of the difference in height between the base portion 21*w*3 and the base portion 21*b*3. As a result, the keyboard apparatus can provide the player with almost the same key touch on both the white key 11*w* and the black key 11*b*. In the first embodiment, furthermore, the plurality of reaction force generation members 21*w* and the plurality of reaction force generation members 21*b* are formed integrally in one piece so that the integrally formed reaction force generation members 21*w* and 21*b* can be assembled easily.

In the above explanation, the difference in height of the lower end surface of the dome portion between the dome portion 21*w*1 of the white key 11*w* and the dome portion 21*b*1 of the black key 11*b* was explained with reference to the upper surface of the supporting portion 31*d*. Instead of the above explanation, however, the difference will now be explained, using the points of intersection between the respective lower end surfaces of the dome portions 21*w*1 and 21*b*1, and the axis lines Yw and Yb. In the above case, the axis line Yw of the dome portion 21*w*1 of the reaction force generation member 21*w* of the white key 11*w* is parallel with the axis line Yb of the dome portion 21*b*1 of the reaction force generation member 21*b* of the black key 11*b* as indicated in FIG. 3 and FIG. 16(A). In this case, therefore, a difference ΔL in distance in the direction of the axis lines Yw and Yb between the respective lower end surfaces of the dome portions 21*w*1 and 21*b*1 can be defined as a distance in the direction of the axis lines Yw and Yb between an intersection point Pw between the lower end surface of the dome portion 21*w*1 and the axis line Yw, and an intersection point Pb between the lower end surface of the dome portion 21*b*1 and the axis line Yb. The difference ΔL in distance can be also defined as a difference in distance between the intersection point Pw between the lower end surface of the dome portion 21*w*1 and the axis line Yw, and an intersection point Pb' between the lower end surface of the dome portion 21*b*1 and the axis line Yw, and can be also defined as a difference in distance between an intersection point Pw' between the lower end surface of the dome portion 21*w*1 and the axis line Yb, and the intersection point Pb between the lower end surface of the dome portion 21*b*1 and the axis line Yb.

As indicated in FIG. 16(B), however, there are cases where the reaction force generation member 21*b* for the black key is assembled such that the reaction force generation member 21*b* for the black key is inclined against the reaction force generation member 21*w* for the white key. In such cases, since the axis lines Yw and Yb are not parallel with each other, it is difficult to define the difference in height of the lower end surface between the dome portions 21*w*1 and 21*b*1 by the above-described scheme. In this specification, therefore, the difference in position of the respective lower end surfaces of the dome portions 21*w*1 and 21*b*1 will be defined by use of either of the axis line Yw of the dome portion 21*w*1 or the axis line Yb of the dome portion 21*b*1, including the case where the axis lines Yw and Yb are parallel with each other. More specifically, a distance in the direction of the axis line Yw between the intersection point Pw between the lower end surface of the dome portion 21*w*1 and the axis line Yw, and the intersection point Pb' between the lower end surface of the dome portion 21*b*1 and the axis line Yw will be defined. Alternatively, a distance in the direction of the axis line Yb between the intersection point Pb between the lower end surface of the dome portion 21*b*1 and the axis line Yb, and the intersection point Pw' between the lower end surface of the dome portion 21*w*1 and the axis line Yb will be defined. In this case as well, furthermore, since the inclination of the axis line Yb against the axis line Yw is exaggerated in FIG. 16(B), there substantially exists a distance in the direction of the axis line Yw (or the axis line Yb) between the lower end surface of the dome portion 21*w*1 and the lower end surface of the dome portion 21*b*1 as in the case of FIG. 16(A). The respective lower end surfaces of the dome portions 21*w*1 and 21*b*1 are positioned similarly in embodiments which will be described later.

The above-described first embodiment is designed such that the dome portion 21*w*1 and the top portion 21*w*2 have exactly the same shape and size as the dome portion 21*b*1 and the top portion 21*b*2, respectively, but may have a slightly different shape, as in the case of the above-described inclination.

Furthermore, the first embodiment is configured such that the reaction force generation members 21*w* and 21*b* are fastened to the supporting portion 31*d* so that the reaction force generation members 21*w* and 21*b* can be depressed by the depression portions 11*w*1 and 11*b*1 of the white key 11*w* and the black key 11*b*, respectively. Instead of this configuration, however, the reaction force generation members 21*w* and 21*b* may be fastened to the white key 11*w* and the black key 11*b*, respectively, with depression portions being provided on the upper plate portion 31*a* of the key frame 31 to be opposed to the reaction force generation members 21$w$ and 21$b$, respectively, so that the reaction force generation members 21$w$ and 21$b$ can be depressed by the depression portions by the pivoting white key 11$w$ and the pivoting black key 11$b$, respectively. In this modification, it is necessary to form each of the reaction force generation members 21$w$ and 21$b$ separately to be individually fastened to the white key 11$w$ and the black key 11$b$.

b. Second Embodiment

Figure 4:
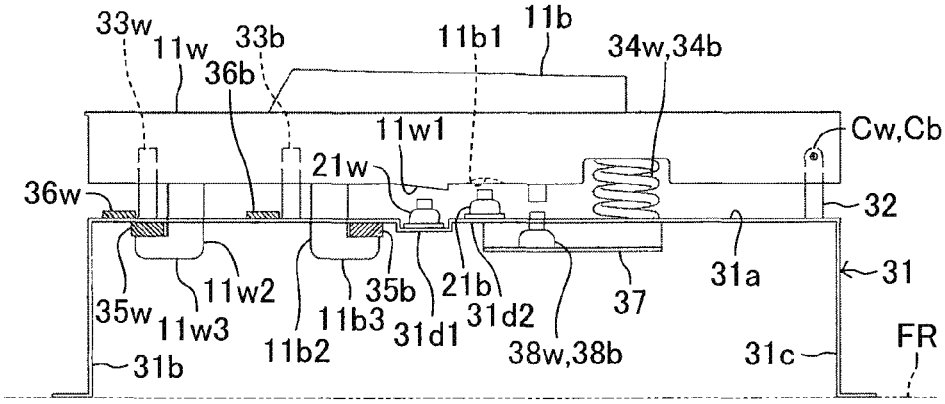
FIG. 4 is a schematic side view of a keyboard apparatus according to the second embodiment of the present invention.
Figure 5:
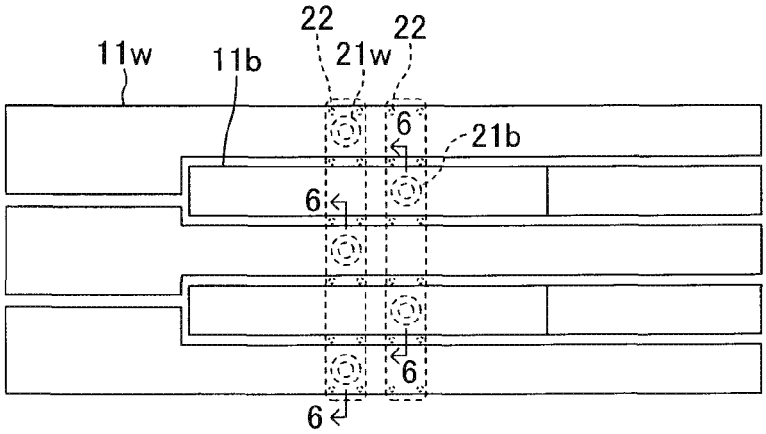
FIG. 5 is a schematic top view of the keyboard apparatus of FIG. 4.
Figure 6:
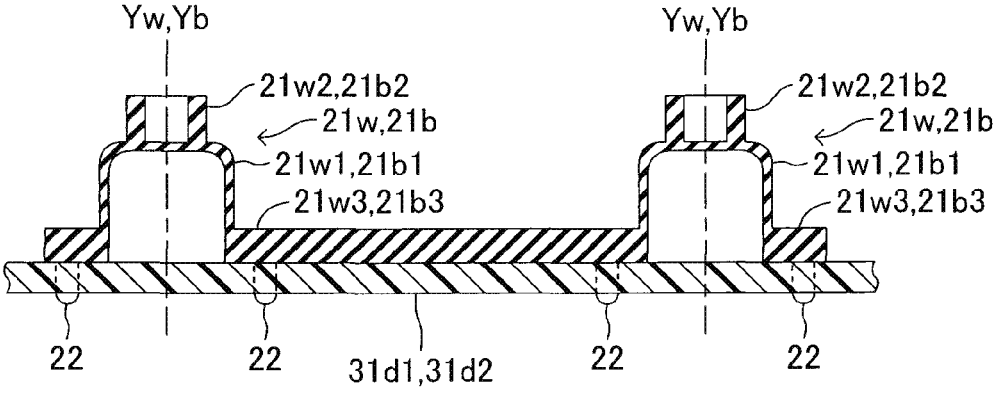
FIG. 6 is an enlarged cross sectional view of reaction force generation members seen along a line 6-6 of FIG. 5.

Next, a keyboard apparatus according to the second embodiment in which the plurality of reaction force generation members 21$w$ of the white keys 11$w$ and the plurality of reaction force generation members 21$b$ of the black keys 11$b$ are arranged in two rows such that the reaction force generation members 21$w$ are displaced in the front-rear direction from the reaction force generation members 21$b$ will be explained. FIG. 4 is a schematic side view of the keyboard apparatus according to the second embodiment seen from the right. FIG. 5 is a schematic top view of the keyboard apparatus. FIG. 6 is an enlarged cross-sectional view indicating the reaction force generation member 21$w$ of the white key 11$w$ and the reaction force generation member 21$b$ of the black key 11$b$ seen along lines 6-6 shown in FIG. 5.

The plurality of reaction force generation members 21$w$ are arranged in the lateral direction on a supporting portion 31$d$1 provided on the upper plate portion 31$a$ of the key frame 31. The supporting portion 31$d$1 extends in the lateral direction such that the supporting portion 31$d$1 is slightly lower than the upper plate portion 31$a$. The plurality of reaction force generation members 21$w$ are formed integrally by elastic body in one piece, with each of the reaction force generation members 21$w$ having the dome portion 21$w$1, the top portion 21$w$2 and the base portion 21$w$3 which are similar to those of the first embodiment. The plurality of dome portions 21$w$1 and top portions 21$w$2 are situated below the depression portions 11$w$1 of the white keys 11$w$. The base portions 21$w$3 are configured to have the same thickness to be shaped like a flat plate to be connected with the dome portions 21$w$1.

The plurality of reaction force generation members 21$b$ are arranged in the lateral direction on a supporting portion 31$d$2 provided on the upper plate portion 31$a$ of the key frame 31. The supporting portion 31$d$2 extends in the lateral direction such that the supporting portion 31$d$2 is situated behind the supporting portion 31$d$1, and is as high as the upper plate portion 31$a$. The plurality of reaction force generation members 21$b$ are also formed integrally by elastic body in one piece, with each of the reaction force generation members 21$b$ having the dome portion 21$b$1, the top portion 21$b$2 and the base portion 21$b$3 which are similar to those of the first embodiment. The plurality of dome portions 21$b$1 and top portions 21$b$2 are situated below the depression portions 11$b$1 of the black keys 11$b$. The depression portions 11$b$1 of the black keys 11$b$ are situated behind the depression portions 11$w$1 of the white keys 11$w$. The base portions 21$b$3 are configured to have the same thickness to be shaped like a flat plate to be connected with the dome portions 21$b$1. In this case, the reaction force generation members 21$w$ of the white keys 11$w$ are provided separately from the reaction force generation members 21$b$ of the black keys 11$b$, but have the same shape as the reaction force generation members 21$b$ of the black keys 11$b$. Particularly, the base portions 21$w$3 and 21$b$3 have the same thickness, and the dome portion 21$w$1 and the top portion 21$w$2 have the same shapes as the dome portion 21$b$1 and the top portion 21$b$2, respectively.

In the second embodiment, furthermore, because of the difference in vertical position between the supporting portions 31$d$1 and 31$d$2, the upper surface of the top portion 21$w$2 of the reaction force generation member 21$w$ is lower than the upper surface of the top portion 21$b$2 of the reaction force generation member 21$b$. The difference in vertical position is adjusted, similarly to the first embodiment, such that the amount of downward travel of the upper surface of the front end of the white key 11$w$ by the depression of the white key 11$w$ is roughly the same as the amount of downward travel of the upper surface of the front end of the black key 11$b$ by the depression of the black key 11$b$ at the start of deformation of the reaction force generation member 21$w$ (the dome portion 21$w$1) and the reaction force generation member 21$b$ (the dome portion 21$b$1), at respective peaks of the reaction forces of the reaction forces of the reaction force generation members 21$w$ and 21$b$, and at the end of the deformation of the reaction force generation members 21$w$ and 21$b$. Since the other configuration of the second embodiment is similar to the first embodiment, components of the second embodiment are given the same numerals as those of the first embodiment to omit their explanations.

In response to the player's depression and release of the white key 11$w$ and the black key 11$b$, the keyboard apparatus according to the second embodiment configured as above also operates similarly to the first embodiment. Furthermore, the second embodiment is configured such that because of the difference in vertical position between the supporting portion 31$d$1 and the supporting portion 31$d$2, the player of the keyboard apparatus of the second embodiment can depress and release both the white key 11$w$ and the black key 11$b$ without any feeling of strangeness, and can perceive roughly the same key touch on the white keys 11$w$ and the black keys 11$b$ in spite of the difference in structure between the white key 11$w$ and the black key 11$b$, because of the reason similar to that of the first embodiment. In the second embodiment, furthermore, the plurality of reaction force generation members 21$w$ are formed integrally in one piece, while the plurality of reaction force generation members 21$b$ are also formed integrally in one piece. Therefore, the integrally formed reaction force generation members 21$w$ and 21$b$ can be assembled easily.

The above-described second embodiment is also designed such that the dome portion 21$w$1 and the top portion 21$w$2 have exactly the same shape and size as the dome portion 21$b$1 and the top portion 21$b$2, respectively, but may have a slightly different shape, as in the case of the first embodiment.

Furthermore, the second embodiment is also configured such that the reaction force generation members 21$w$ and 21$b$ are fastened to the supporting portions 31$d$1 and 31$d$2, respectively, so that the reaction force generation members 21$w$ and 21$b$ can be depressed by the depression portions 11$w$1 and 11$b$1 of the white key 11$w$ and the black key 11$b$, respectively. Instead of this configuration, however, the reaction force generation members 21$w$ and 21$b$ may be fastened to the white key 11$w$ and the black key 11$b$, respectively, with depression portions being provided on the upper plate portion 31$a$ of the key frame 31 to be opposed to the reaction force generation members 21$w$ and 21$b$, respectively, so that the reaction force generation members 21$w$ and 21$b$ can be depressed by the depression portions by the pivoting white key 11$w$ and the pivoting black key 11$b$, respectively. In this modification as well, it is necessary to form each of the reaction force generation members 21*w* and 21*b* separately to be individually fastened to the white key 11*w* and the black key 11*b*.

c. Third Embodiment

Figure 7:
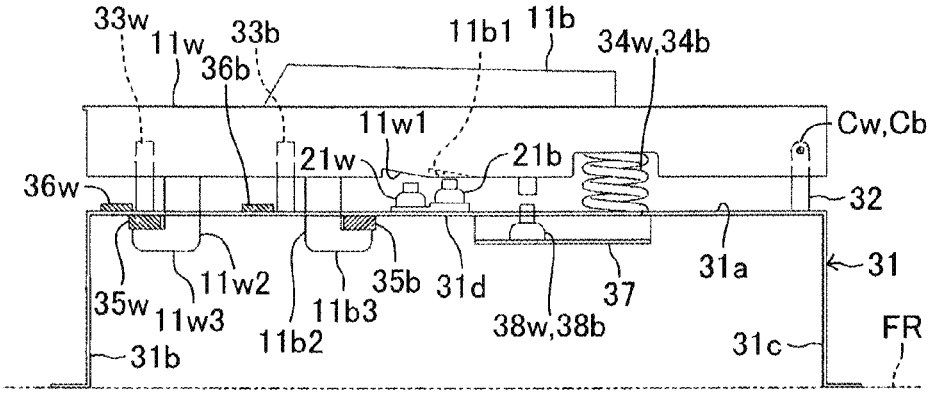
FIG. 7 is a schematic side view of a keyboard apparatus according to the third embodiment of the present invention.
Figure 8:
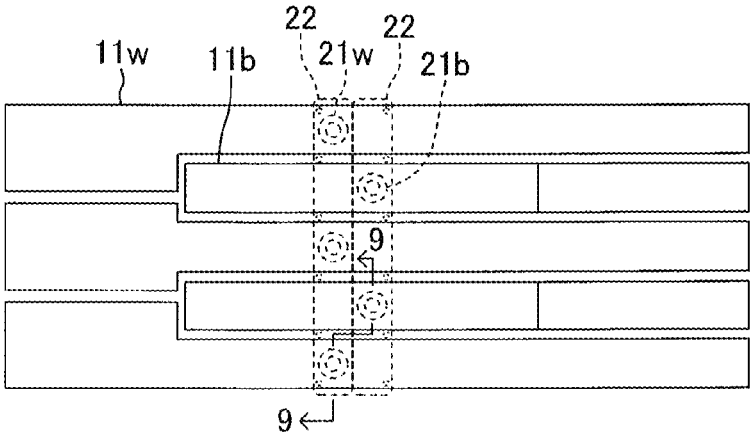
FIG. 8 is a schematic top view of the keyboard apparatus of FIG. 7.
Figure 9:
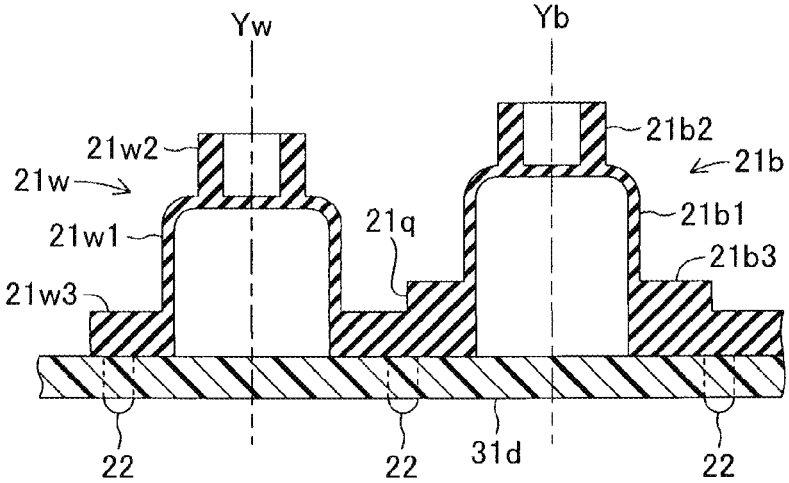
FIG. 9 is an enlarged cross sectional view of reaction force generation members seen along a line 9-9 of FIG. 8.

Next, a keyboard apparatus according to the third embodiment in which the plurality of reaction force generation members 21*w* of the white keys 11*w* and the plurality of reaction force generation members 21*b* of the black keys 11*b* of the above second embodiment are integrally formed in one piece will be explained. FIG. 7 is a schematic side view of the keyboard apparatus according to the third embodiment seen from the right. FIG. 8 is a schematic top view of the keyboard apparatus. FIG. 9 is an enlarged cross-sectional view indicating the reaction force generation members 21*w* and 21*b* of the white key 11*w* and the black key 11*b* seen along a line 9-9 shown in FIG. 8.

The third embodiment is configured such that the plurality of reaction force generation members 21*w* and the plurality of reaction force generation members 21*b* of the above second embodiment are formed integrally in one piece, while the reaction force generation members 21*w* and 21*b* have the dome portions 21*w*1 and 21*b*1, the top portions 21*w*2 and 21*b*2, and the base portions 21*w*3 and 21*b*3 which are similar to those of the first and second embodiments, respectively. In this embodiment, respective undersurfaces of the plurality of base portions 21*w*3 and 21*b*3 form a seamless horizontal plane to have a step 21*q* between an upper surface of the seamless base portions 21*w*3 and an upper surface of the seamless base portions 21*b*3. The integrally formed reaction force generation members 21*w* and 21*b* are provided on the supporting portion 31*d* provided on the upper plate portion 31*a*. Because of such a configuration, the upper surface of the top portion 21*w*2 of the reaction force generation member 21*w* is lower than the upper surface of the top portion 21*b*2 of the reaction force generation member 21*b*. The difference in vertical position is adjusted, similarly to the first and second embodiments, such that the amount of downward travel of the upper surface of the front end of the white key 11*w* by the depression of the white key 11*w* is roughly the same as the amount of downward travel of the upper surface of the front end of the black key 11*b* by the depression of the black key 11*b* at the start of deformation of the reaction force generation member 21*w* (the dome portion 21*w*1) and the reaction force generation member 21*b* (the dome portion 21*b*1), at respective peaks of the reaction forces of the reaction force generation members 21*w* and 21*b*, and at the end of the deformation of the reaction force generation members 21*w* and 21*b*. Since the other configuration of the third embodiment is similar to the first embodiment, components of the third embodiment are given the same numerals as those of the first embodiment to omit their explanations.

In response to the player's depression and release of the white key 11*w* and the black key 11*b*, the keyboard apparatus according to the third embodiment configured as above also operates similarly to the first and second embodiments. Furthermore, the third embodiment is configured such that because of the difference in thickness of the base portion, that is, in length of the base portion in the direction of the axis lines Yw and Yb between the base portion 21*w*3 of the white key 11*w* and the base portion 21*b*3 of the black key 11*b*, the player of the keyboard apparatus of the third embodiment can depress and release both the white key 11*w* and the black key 11*b* without any feeling of strangeness, and can perceive roughly the same key touch on the white keys 11*w* and the black keys 11*b* in spite of the difference in structure between the white key 11*w* and the black key 11*b* because of the reason similar to that of the first and second embodiments. In the third embodiment, furthermore, the plurality of reaction force generation members 21*w* and the plurality of reaction force generation members 21*b* are formed integrally in one piece, so that the integrally formed reaction force generation members 21*w* and 21*b* can be assembled easily.

The above-described third embodiment is also designed such that the dome portion 21*w*1 and the top portion 21*w*2 have exactly the same shape and size as the dome portion 21*b*1 and the top portion 21*b*2, respectively, but may have a slightly different shape, as in the case of the first and second embodiments.

Figure 10:
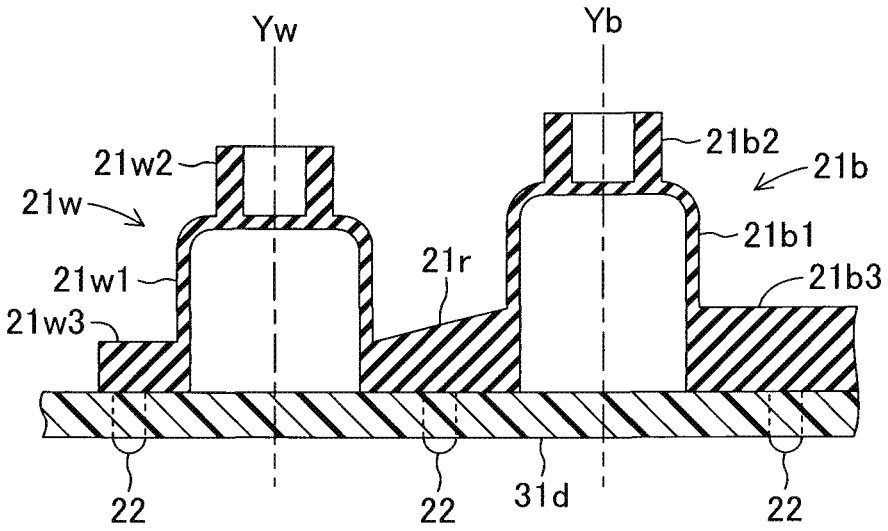
FIG. 10 is an enlarged cross sectional view of a modification of the reaction force generation members of the third embodiment.

The third embodiment is designed such that the step 21*q* is provided between the base portions 21*w*3 and the base portions 21*b*3. Instead of the step 21*q*, however, a slanting surface 21*r* may be provided to connect the base portions 21*w*3 with the base portions 21*b*3 to make a difference in vertical position of the lower end surface between the dome portions 21*w*1 and the dome portions 21*b*1 as indicated in FIG. 10. Further, this modification can be applied to the above first embodiment in which the reaction force generation members 21*w* and 21*b* are arranged in a row in the lateral direction of the keyboard. In other words, regarding the reaction force generation members 21*w* and 21*b* shown in FIG. 3, instead of the step 21*p*, a slanting surface may be provided to connect the base portions 21*w*3 with the base portions 21*b*3 to make a difference in vertical position of the lower end surface between the dome portions 21*w*1 and the dome portions 21*b*1.

Furthermore, the third embodiment and its modification are designed such that the rear end of the dome portion 21*w*1 of the white key 11*w* (the right end of the dome portion 21*w*1 in FIG. 8) is situated in front of (on the left side in FIG. 8) the front end of the dome portion 21*b*1 of the black key 11*b* (the left end of the dome portion 21*b*1 in FIG. 8). However, the third embodiment and its modification may be modified such that the rear end of the dome portion 21*w*1 of the white key 11*w* is situated in between the front end and the rear end of the dome portion 21*b*1 of the black key 11*b*. In other words, the dome portion 21*w*1 may be situated in front of the dome portion 21*b*1, with a part of the dome portion 21*w*1 overlapping with the dome portion 21*b*1 in the front-rear direction.

d. Fourth Embodiment

Figure 11:
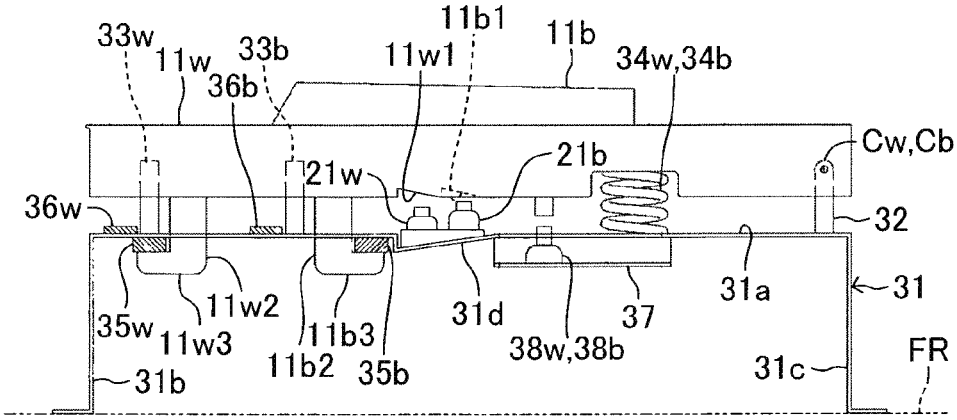
FIG. 11 is a schematic side view of a keyboard apparatus according to the fourth embodiment of the present invention.
Figure 12:
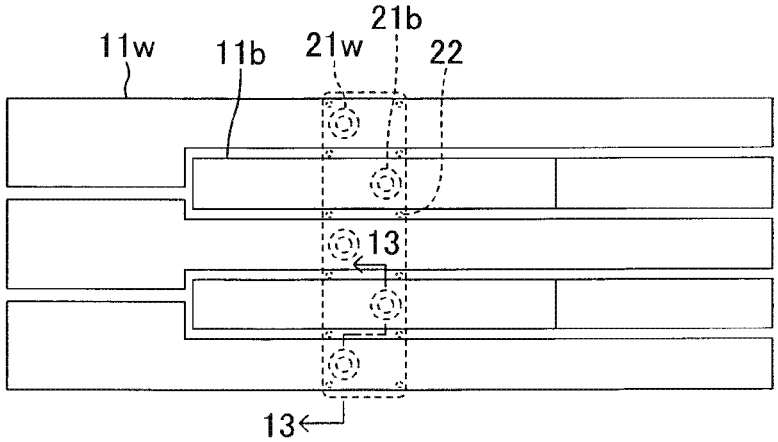
FIG. 12 is a schematic top view of the keyboard apparatus of FIG. 11.
Figure 13:
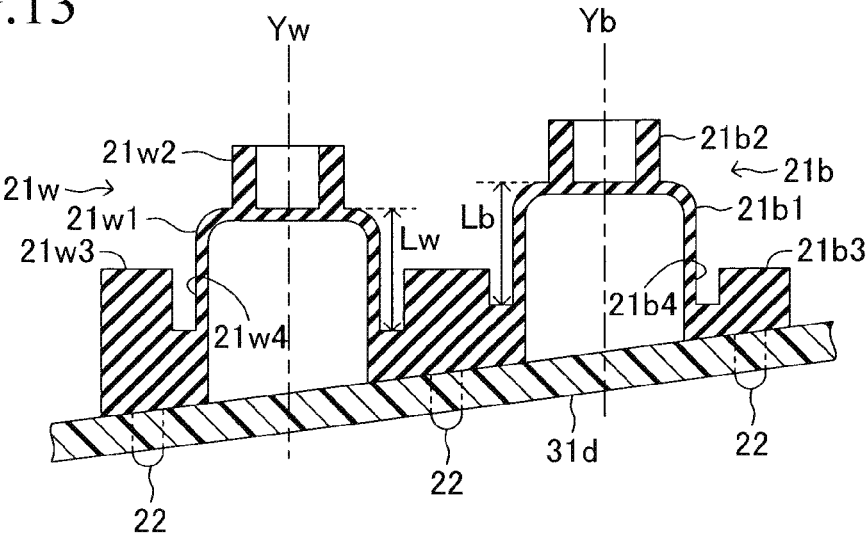
FIG. 13 is an enlarged cross sectional view of reaction force generation members seen along a line 13-13 of FIG. 12.

Next, a keyboard apparatus according to the fourth embodiment in which respective bottom surfaces of the base portions 21*w*3 and 21*b*3 of the reaction force generation members 21*w* and 21*b* are inclined, with the supporting portion 31*d* provided on the upper plate portion 31*a* of the key frame 31 being also inclined will be explained. FIG. 11 is a schematic side view of the keyboard apparatus according to the fourth embodiment seen from the right. FIG. 12 is a schematic top view of the keyboard apparatus. FIG. 13 is an enlarged cross-sectional view indicating the reaction force generation members 21*w* and 21*b* of the white key 11*w* and the black key 11*b* seen along a line 13-13 shown in FIG. 12.

The fourth embodiment is configured such that the supporting portion 31*d* is inclined such that the front side of the supporting portion 31*d* is lower than the rear side, while the supporting portion 31*d* is formed integrally with the upper plate portion 31*a*. In the fourth embodiment, similarly to the second and third embodiments, the depression portions 11$w$1 of the white key 11$w$ are located on the front side, with the depression portions 11$b$1 of the black key 11$b$ being located on the rear side, so that the depression portions 11$w$1 and the depression portions 11$b$1 form two rows. More specifically, each of the depression portions 11$w$ and 11$b$1 is configured such that the front side of the depression portion is higher than the rear side to be a flat surface.

The plurality of reaction force generation members 21$w$ and the plurality of reaction force generation members 21$b$ are formed integrally in one piece, while the reaction force generation members 21$w$ and 21$b$ have the dome portions 21$w$1 and 21$b$1, the top portions 21$w$2 and 21$b$2, and the base portions 21$w$3 and 21$b$3 which are similar to those of the first to third embodiments, respectively. In this embodiment, respective undersurfaces of the plurality of base portions 21$w$3 and 21$b$3 form a seamless slanting plane, while respective upper surfaces of the base portions 21$w$3 and 21$b$3 are horizontal and flat. At the outside of the outer periphery of the dome portion 21$w$1, a cylindrical gap 21$w$4 provided by notching the base portion 21$w$3 is provided, while a cylindrical gap 21$b$4 provided by notching the base portion 21$b$3 is provided at the outside of the outer periphery of the dome portion 21$b$1. The width in a radial direction of the gaps 21$w$4 and 21$b$4 is set to be within an extent which prevents the outer periphery of the dome portions 21$w$1 and 21$b$1 from coming into contact with the inner surface of the gaps 21$w$4 and 21$b$4 when the dome portions 21$w$1 and 21$b$1 are deformed by the top portions 21$w$2 and 21$b$2 depressed from above, respectively.

In this embodiment, the height of the dome portions 21$w$1 and 21$b$1 indicates the height measured from the bottom surface of the gaps 21$w$4 and 21$b$4 to the upper surface of the dome portions 21$w$1 and 21$b$1, respectively. Furthermore, the fourth embodiment is designed such that by making the depth of the gap 21$w$4 deeper than the gap 21$b$4, the height of the dome portion 21$w$1 and the top portion 21$w$2 is lower than the height of the dome portion 21$b$1 and the top portion 21$b$2. The dome portion 21$w$1 and the top portion 21$w$2 have the same shape as the dome portion 21$b$1 and the top portion 21$b$2, so that a distance Lw between the lower end surface to the upper end surface of the dome portion 21$w$1 is equal with a distance Lb between the lower end surface to the upper end surface of the dome portion 21$b$1. The difference in height between the dome portions 21$w$1 and 21$b$1 is adjusted, similarly to the first to third embodiments, such that the amount of downward travel of the upper surface of the front end of the white key 11$w$ by the depression of the white key 11$w$ is roughly the same as the amount of downward travel of the upper surface of the front end of the black key 11$b$ by the depression of the black key 11$b$ at the start of deformation of the reaction force generation member 21$w$ (the dome portion 21$w$1) and the reaction force generation member 21$b$ (the dome portion 21$b$1), at respective peaks of the reaction forces of the reaction force generation members 21$w$ and 21$b$, and at the end of the deformation of the reaction force generation members 21$w$ and 21$b$. Since the other configuration of the fourth embodiment is similar to the first to third embodiments, components of the fourth embodiment are given the same numerals as those of the first to third embodiments to omit their explanations.

In response to the player's depression and release of the white key 11$w$ and the black key 11$b$, the keyboard apparatus according to the fourth embodiment configured as above also operates similarly to the first to third embodiments. Furthermore, the fourth embodiment is configured such that because of the difference in depth of the gap between the gap 21$w$4 and the gap 21$b$4, the player of the keyboard apparatus of the fourth embodiment can depress and release both the white key 11$w$ and the black key 11$b$ without any feeling of strangeness, and can perceive roughly the same key touch on the white keys 11$w$ and the black keys 11$b$ in spite of the difference in structure between the white key 11$w$ and the black key 11$b$ because of the reason similar to that of the first to third embodiments. In the fourth embodiment, furthermore, the plurality of reaction force generation members 21$w$ and the plurality of reaction force generation members 21$b$ are formed integrally in one piece, with respective bottom surfaces of the base portions 21$w$3 and 21$b$3 being seamlessly inclined, so that the integrally formed reaction force generation members 21$w$ and 21$b$ can be easily provided on the inclined supporting portion 31$d$.

The above-described fourth embodiment is also designed such that the dome portion 21$w$1 and the top portion 21$w$2 have exactly the same shape and size as the dome portion 21$b$1 and the top portion 21$b$2, respectively, but may have a slightly different shape, as in the cases of the first to third embodiments.

Figure 14:
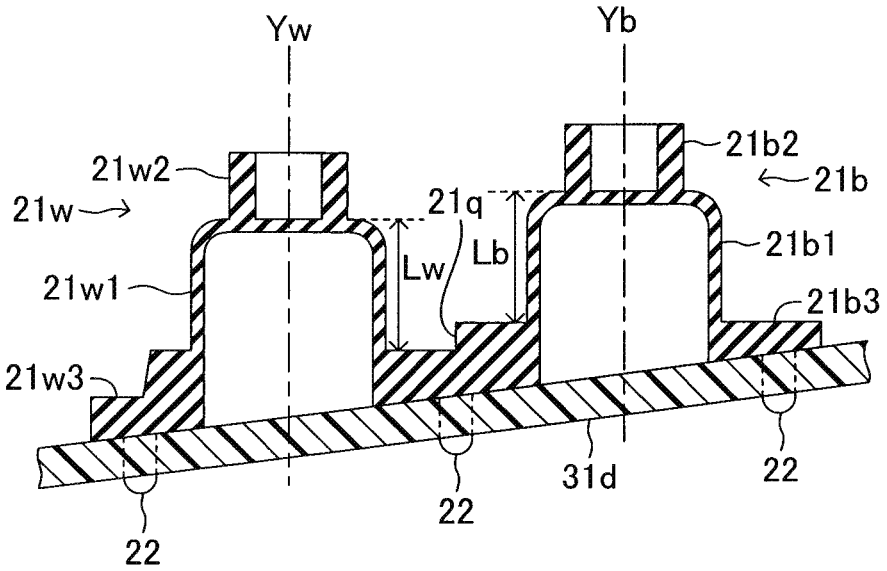
FIG. 14 is an enlarged cross sectional view of a modification of the reaction force generation members of the fourth embodiment.

In the fourth embodiment, furthermore, the difference in depth between the gaps 21$w$4 and 21$b$4 makes a difference in height between the dome portion 21$w$1 and the top portion 21$w$2, and the dome portion 21$b$1 and the top portion 21$b$2. However, the fourth embodiment may be modified as indicated in FIG. 14 such that without the gaps 21$w$4 and 21$b$4, the step 21$q$ is provided between the upper surface of the base portions 21$w$3 and the upper surface of the base portions 21$b$3, with the undersurface of the base portions 21$w$3 and 21$b$3 being inclined. By this modification as well, the dome portion 21$w$1 and the top portion 21$w$2 can have the same shape as the dome portion 21$b$1 and the top portion 21$b$2, with different height between the dome portion 21$w$1 and the top portion 21$w$2, and the dome portion 21$b$1 and the top portion 21$b$2. Instead of the step 21$q$, similarly to the modification of the third embodiment, the slanting surface 21$r$ may be provided to connect the base portions 21$w$3 with the base portions 21$b$3 to make a difference in the vertical position of the lower end surface between the dome portion 21$w$1 and the dome portion 21$b$1 (see FIG. 10).

Furthermore, the fourth embodiment and its modifications are designed such that the rear end of the dome portion 21$w$1 of the white key 11$w$ (the right end of the dome portion 21$w$1 in FIG. 12) is situated in front of (on the left side in FIG. 12) the front end of the dome portion 21$b$1 of the black key 11$b$ (the left end of the dome portion 21$b$1 in FIG. 12). However, the fourth embodiment and its modifications may also be modified such that the rear end of the dome portion 21$w$1 of the white key 11$w$ is situated in between the front end and the rear end of the dome portion 21$b$1 of the black key 11$b$. In other words, the dome portion 21$w$1 may be situated in front of the dome portion 21$b$1, with a part of the dome portion 21$w$1 overlapping with the dome portion 21$b$1 in the front-rear direction.

e. Fifth Embodiment

Figure 15:
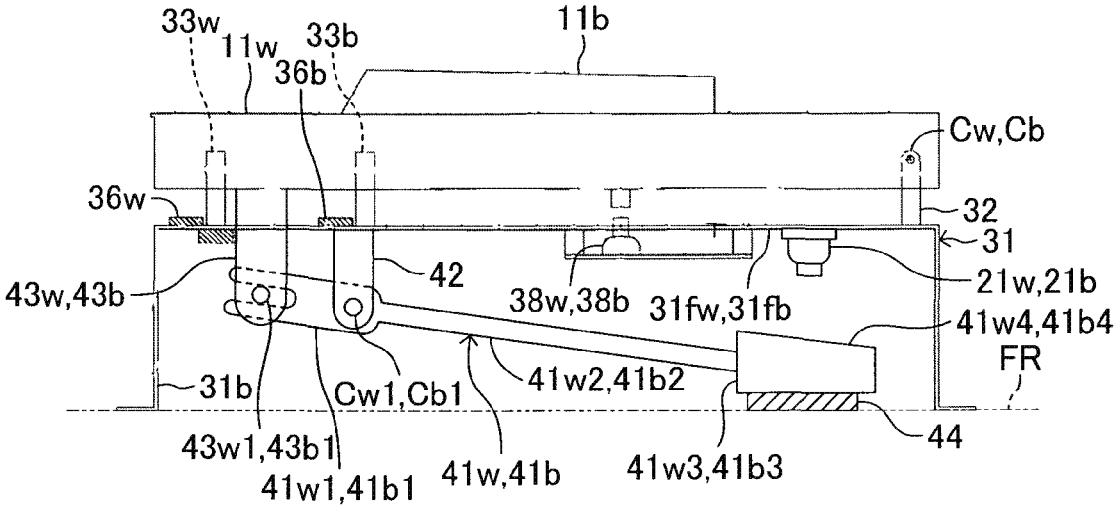
FIG. 15 is a schematic side view of a keyboard apparatus according to the fifth embodiment of the present invention.

Next, the fifth embodiment in which pivoting bodies which pivot in conjunction with pivoting of the white key 11$w$ and the black key 11$b$ depress the reaction force generation members 21$w$ and 21$b$ will be explained. FIG. 15 indicates a keyboard apparatus according to the fifth embodiment. The keyboard apparatus has hammers 41$w$ and 41$b$ which are the above-described pivoting bodies such that the hammers 41$w$ and 41$b$ correspond to the white key 11$w$ and the black key 11$b$, respectively.

The hammers 41$w$ and 41$b$ are supported by hammer supporting members 42 provided for the respective white key 11$w$ and black key 11$b$ so that the hammers 41$w$ and 41$b$ can pivot. Each of the hammer supporting members 42 extends downward from the undersurface of the upper plate portion 31$a$ such that the hammer supporting member 42 is situated at the middle of the white key 11$w$ and the black key 11$b$ in the front-rear direction. The hammers 41$w$ and 41$b$ are formed of base portions 41$w$1 and 41$b$1, connecting rods 41$w$2 and 41$b$2, and mass bodies 41$w$3 and 41$b$3, respectively. The base portions 41$w$1 and 41$b$1 are supported at the middle portion thereof by the hammer supporting members 42 so that the hammers 41$w$ and 41$b$ can pivot about pivot axes Cw1 and Cb1, respectively. More specifically, the mass bodies 41$w$3 and 41$b$3 pivot up and down. Each of the base portions 41$w$1 and 41$b$1 has bifurcated legs at the front portion. Between the legs, drive shafts 43$w$1 and 43$b$1 provided on extending portions 43$w$ and 43$b$ extending vertically from the undersurface of the white key 11$w$ and the black key 11$b$ penetrate so that the drive shafts 43$w$1 and 43$b$1 can slide, respectively. The extending portions 43$w$ and 43$b$ penetrate through a through-hole provided on the upper plate portion 31$a$ so that the extending portions 43$w$ and 43$b$ can be displaced up and down. As a result, the respective front ends of the base portions 41$w$1 and 41$b$1 are to be displaced downward when the white key 11$w$ and the black key 11$b$ are depressed. The connecting rods 41$w$2 and 41$b$2 extend in the front-rear direction to connect the base portions 41$w$1 and 41$b$1 with the mass bodies 41$w$3 and 41$b$3, respectively. The mass bodies 41$w$3 and 41$b$3 urge the respective front ends of the hammers 41$w$ and 41$b$ upward, using the mass of the mass bodies 41$w$3 and 41$b$3, respectively.

Below each of the mass bodies 41$w$3 and 41$b$3, an upper limit stopper member 44 for preventing the mass bodies 41$w$3 and 41$b$3 from moving downward is fastened to the frame FR. The upper limit stopper member 44 is also made of a cushioning material such as felt. In the key-release state, therefore, the mass bodies 41$w$3 and 41$b$3 are situated on the upper limit stopper member 44 in order to restrict upward move of the front end of the white key 11$w$ and the black key 11$b$. Therefore, the keyboard apparatus of the fifth embodiment does not have the upper limit stopper members 35$w$ and 35$b$, and the extending portions 11$w$2 and 11$b$2 provided for the first embodiment.

The reaction force generation members 21$w$ and 21$b$ are fastened to the respective undersurfaces of supporting portions 31$fw$ and 31$fb$ provided on the upper plate portion 31$a$ such that the reaction force generation members 21$w$ and 21$b$ are opposed to the mass bodies 41$w$3 and 41$b$3, respectively. The respective upper surfaces of the mass bodies 41$w$3 and 41$b$3 serve as flat depression portion 41$w$4 and 41$b$4, respectively, to face the undersurfaces (equivalent to the upper surfaces of the first to fourth embodiments) of the top portions 21$w$2 and 21$b$2 of the reaction force generation members 21$w$ and 21$b$ in the key-release state. When the keys are depressed, the depression portions 41$w$4 and 41$b$4 move upward to come into contact with the undersurface of the top portions 21$w$2 and 21$b$2 to depress the reaction force generation members 21$w$ and 21$b$, respectively. In this case as well, the reaction force generation members 21$w$ and 21$b$ are elastically deformed by the depression to buckle after the reaction forces reach their peaks, respectively. Furthermore, since the hammers 41$w$ and 41$b$ exert a reaction force against the depression of the white key 11$w$ and the black key 11$b$, respectively, the keyboard apparatus of the fifth embodiment may have the springs 34$w$ and 34$b$ provided for the first embodiment, but does not have the springs 34$w$ and 34$b$ in the fifth embodiment.

In the fifth embodiment as well, the reaction force generation members 21$w$ and 21$b$ are configured such that because of the difference in the amount of vertical travel of the mass bodies 41$w$3 and 41$b$3 between the white key 11$w$ and the black key 11$b$, the respective vertical positions of the dome portion 21$w$1 and the top portion 21$w$2 are different from the respective vertical positions of the dome portion 21$b$1 and the top portion 21$b$2, similarly to the first embodiment. The reaction force generation members 21$w$ and 21$b$ are configured and shaped similarly to those of the first embodiment. Since the other configuration of the fifth embodiment is similar to the first embodiment, components of the fifth embodiment are given the same numerals as those of the first embodiment to omit their explanations.

According to the fifth embodiment configured as above, when the white key 11$w$ and the black key 11$b$ are depressed, the drive shafts 43$w$1 and 43$b$1 of the extending portions 43$w$ and 43$b$ move downward, so that the hammers 41$w$ and 41$b$ pivot about the pivot axes Cw1 and Cb1 in the counterclockwise direction, respectively. Then, the depression portions 41$w$4 and 41$b$4 of the mass bodies 41$w$3 and 41$b$3 of the hammers 41$w$ and 41$b$ depress the reaction force generation members 21$w$ and 21$b$, respectively, so that the reaction force generation members 21$w$ and 21$b$ elastically deform to buckle. If the white key 11$w$ and the black key 11$b$ are depressed further, the reaction force generation members 21$w$ and 21$b$ elastically deform further, so that the depressions of the white key 11$w$ and the black key 11$b$ are finished by the contact between the undersurface of the front end of the white key 11$w$ and the black key 11$b$ and the lower limit stopper members 36$w$ and 36$b$. When the white key 11$w$ and the black key 11$b$ are depressed, the hammers 41$w$ and 41$b$, and the reaction force generation members 21$w$ and 21$b$ give reaction forces to the player against the depressions.

When the white key 11$w$ and the black key 11$b$ are released, the hammers 41$w$ and 41$b$ pivot in the clockwise direction because of the mass of the mass bodies 41$w$3 and 41$b$3, respectively, so that the front end of the white key 11$w$ and the black key 11$b$ moves upward. If the undersurface of the mass bodies 41$w$3 and 41$b$3 comes into contact with the upper limit stopper member 44, the white key 11$w$ and the black key 11$b$ stop pivoting, so that the white key 11$w$ and the black key 11$b$ return to the original key-release state.

According to the keyboard apparatus according to the fifth embodiment configured to operate as above, in spite of the difference in structure between the white key 11$w$ and the black key 11$b$, the player of the keyboard apparatus can depress and release both the white key 11$w$ and the black key 11$b$ without any feeling of strangeness, and can perceive roughly the same key touch on the white keys 11$w$ and the black keys 11$b$ because of the reason similar to that of the first embodiment. In the fifth embodiment, furthermore, the plurality of reaction force generation members 21$w$ and the plurality of reaction force generation members 21$b$ are formed integrally in one piece, so that the reaction force generation members 21$w$ and 21$b$ can be assembled easily.

The fifth embodiment may be also modified, similarly to the second to fourth embodiments and their modifications, such that the plurality of reaction force generation members 21$w$ of the white keys 11$w$ and the plurality of reaction force generation members 21$b$ of the black keys 11$b$ are laterally arranged in two rows in the front-rear direction. In this modification as well, furthermore, the plurality of reaction force generation members 21*w* may be integrally formed in one piece, with the plurality of reaction force generation members 21*b* being also integrally formed in one piece. Alternatively, the plurality of reaction force generation members 21*w* may be formed integrally with the plurality of reaction force generation members 21*b*.

Similarly to the modifications of the first and second embodiments, furthermore, the keyboard apparatus having the hammers 41*w* and 41*b* may be modified such that the reaction force generation members 21*w* and 21*b* are fastened to the respective upper surfaces of the mass bodies 41*w*3 and 41*b*3 of the hammers 41*w* and 41 *b*, with depression portions for depressing the respective upper surfaces of the top portions 21*w*2 and 21*b*2 of the reaction force generation members 21*w* and 21*b* being provided on the undersurface of the upper plate portion 31*a* of the key frame 31 which faces the hammers 41*w* and 41*b*, respectively.

f. Other Modifications

The first to fifth embodiments and their modifications were explained as examples in which the lower end of the dome portion 21*w*1 of the reaction force generation member 21*w* of the white key 11*w* is lower than the lower end of the dome portion 21*b*1 of the reaction force generation member 21*b* of the black key 11*b*. Depending on the structure of the white keys 11*w* and the black keys 11*b*, however, there can be cases where the lower end of the dome portion 21*w*1 of the reaction force generation member 21*w* of the white key 11*w* is higher than the lower end of the dome portion 21*b*1 of the reaction force generation member 21*b* of the black key 11*b*.

The first to fifth embodiments and their modifications are configured such that the dome portion 21*w* and the top portion 21*w*2 of the reaction force generation member 21*w* of the white key 11*w* have the same shape and size as the dome portion 21*b*1 and the top portion 21*b*2 of the reaction force generation member 21*b* of the black key 11*b*. However, since the top portions 21*w*2 and 21*b*2 are hardly deformed by depression, the shape and the size of the top portions 21*w*2 and 21*b*2, particularly, the length from the upper surface to the undersurface in the direction of the axis lines Yw and Yb may be different between the top portion 21*w*2 and the top portion 21*b*2.

The first to fifth embodiments and their modifications are configured such that the reaction force generation members 21*w* and 21*b* are provided separately from the key switches 38*w* and 38*b*, respectively. Instead of such a configuration, however, the key switches 38*w* and 38*b* may be configured similarly to the reaction force generation members 21*w* and 21*b* so that the key switches 38*w* and 38*b* can be used as a reaction force generation member. In this modification, each of the dome portions 21*w*1 and 21*b*1 is to have a two-tier configuration having an inner portion and an outer portion, with a tubular less-deformable switch portion being provided between the inner portion and outer portion. In this modification, more specifically, by deformation of the outer portion, an increasing reaction force is generated against a depression of the key, while a contact provided on a board is opened or closed by the switch portion, with a reaction force against the key-depression being generated by deformation and buckling of the inner portion.

Furthermore, the first to fifth embodiments and their modifications were explained as examples in which the white keys 11*w* and the black keys 11*b* pivot about a rotational axis. However, the axis may be a hinge-type pivot axis. More specifically, the hinge-type pivot axis is configured such that a plate-like thin portion is provided on the rear end of the white key 11*w* and the black key 11*b* so that the rear end of the thin portion can be supported by a supporting member to allow the white key 11*w* and the black key 11*b* to pivot by elastic deformation of the thin portion. In this modification, however, the pivot axes Cw and Cb slightly vary with the pivoting of the white key 11*w* and the black key 11*b*, respectively. That is, the respective positions of the pivot axes Cw and Cb vary with the passage of time.

In FIGS. 16 A and B, the reaction force generating members are embodied as spring members 21*w* and 21*b*. The spring members 21*w* and 21*b* are mounted at a mounting height with respect to the frame (for example frame 31) of the musical instrument that is different for the spring members 21*w* and 21*b*. The difference in mounting height is denoted by delta L in FIG. 16 A. In this embodiment the spring members are the same, and therefore the difference in mounting height is easily discernible. Also in the case of the construction of FIG. 16 B, a difference in mounting height due to the difference in rotation can be discerned. In case that the spring members are of different type for white and black keys, the difference in mounting height can be determined by the difference in height for similar parts; if for instance the flanges 21*w*3 and 21*b*3 are shaped different (like for instance in FIG. 9), but the upper sections 21*w*1 and 21*w*2, and 21*b*1 and 21*b*2 respectively similar, then the mounting height difference can be determined by the position of the respective parts 21*w*1 and 21*w*2, and 21*b*1 and 21*b*2. The difference in mounting height can also be seen in the part of the spring members that elastically deforms (in this embodiment the dome shaped portion): for identical spring members the lower and upper sections are mounted at a different height. This can be determined for example by the difference in mounting height for the lower non-moving section of the spring members. For non-identical spring members the lower sections can be mounted at the same height, provided that the upper sections are of different mounting heights. Conversely, for non-identical spring members the upper sections can be mounted at the same height, provided that the lower sections are of different mounting heights.

What is claimed is:

1. A keyboard apparatus for an electronic musical instrument, the keyboard apparatus comprising:

a plurality of keys composed of white keys and black keys, each key pivoting about a corresponding pivot axis so that a front end thereof is movable up and down; and a plurality of reaction force generation members each provided for one of the plurality of keys, and made of an elastic body, wherein each of the plurality of reaction force generation members is depressable by a depression of the corresponding key to generate a reaction force against the depression of the corresponding key, wherein each of the reaction force generation members has a dome portion, which is thin and having a dome shape, the dome portion being elastically deformed by depression, and a base portion, which is thick and integral with the dome portion to support the dome portion, extending downwardly and radially outwardly from a lower end of the dome portion, wherein a position of a point of intersection between a first line extending across the lower end surface of the dome portion of one of the white keys and an axis line of the dome portion of either the one white key or one of the black keys is vertically displaced from a position of a point of intersection between a second line extending across the lower end surface of the dome portion of the one black key and the axis line of the dome portion of either the one white key or the one black key, and wherein the first line is perpendicular to the axis line of the dome portion of the one white key and the second line is perpendicular to the axis line of the dome portion of the one black key.

2. The keyboard apparatus for an electronic musical instrument according to claim 1, wherein the position of the point of intersection between the first line and the axis line of the dome portion of the one white key is vertically displaced from the position of the point of intersection between the second line and the axis line of the dome portion of the one black key.

3. The keyboard apparatus for an electronic musical instrument according to claim 1, wherein the position of the point of intersection between the first line and the axis line of the dome portion of the one white key is vertically displaced from the position of the point of intersection between the second line and the axis line of the dome portion of the one white key.

4. The keyboard apparatus for an electronic musical instrument according to claim 1, wherein:

the reaction force generation members of the white keys are integral with the reaction force generation members of the black keys; and the base portion of each of the white keys is shaped differently from the base portion of each of the black keys.

5. The keyboard apparatus for an electronic musical instrument according to claim 4, wherein a step or slope is provided between an upper surface of the base portion of the one white key and an upper surface of the base portion of the one black key.

6. The keyboard apparatus for an electronic musical instrument according to claim 3, wherein:

the reaction force generation members of the white keys are integral with the reaction force generation members of the black keys; and an undersurface of the base portion of the one white key and an undersurface of the base portion of the one black key are seamlessly inclined in the direction in which the one white key and the one black key extend.

7. The keyboard apparatus for an electronic musical instrument according to claim 1, wherein the dome portion of the one white key has the same shape and size as the dome portion of the one black key.

8. A keyboard apparatus for an electronic musical instrument, the keyboard apparatus comprising:

a plurality of keys composed of white keys and black keys, each key pivoting about a corresponding pivot axis so that a front end thereof is movable up and down, and a plurality of reaction force generation members each provided for one of the plurality of keys, and made of an elastic body, wherein each of the plurality of reaction force generation members is depressable by a depression of the corresponding key to generate a reaction force against the depression of the corresponding key, wherein each of the reaction force generation members has a body portion, which is thin so as to be elastically deformed by depression, and a base portion, which is thick and integral with the body portion to support the body portion, extending downwardly and outwardly from a lower end of the body portion, and wherein the lower end of the body portion of one of the white keys is displaced in a vertical direction from the lower end of the body portion of one of the black keys.

9. A keyboard apparatus for an electronic musical instrument, the keyboard apparatus comprising:

a plurality of keys composed of white keys and black keys, each key pivoting about a corresponding pivot axis so that a front end thereof is movable up and down; and a plurality of reaction force generation members each provided for one of the plurality of keys, and made of an elastic body, wherein each of the plurality of reaction force generation members is depressable by a depression of the corresponding key to generate a reaction force against the depression of the corresponding key, wherein each of the reaction force generation members has a dome portion, which is thin and having a dome shape, the dome portion being elastically deformed by depression, and a base portion, which is thick and integral with the dome portion to support the dome portion, extending downwardly and radially outwardly from a lower end of the dome portion, and wherein the lower end of the body portion of one of the white keys is displaced in a vertical direction from the lower end of the body portion of one of the black keys.

* * * * *